United States Patent [19]

Ristvedt

[11] Patent Number: 4,718,218

[45] Date of Patent: Jan. 12, 1988

[54] COIN WRAPPING MECHANISM

[75] Inventor: Victor G. Ristvedt, Manchester, Tenn.

[73] Assignee: Ristvedt-Johnson, Inc., Mt. Prospect, Ill.

[21] Appl. No.: 785,343

[22] Filed: Oct. 7, 1985

[51] Int. Cl.[4] ..... B65B 11/04

[52] U.S. Cl. ..... 53/532; 53/212

[58] Field of Search ..... 53/211-217, 53/532

[56] References Cited

U.S. PATENT DOCUMENTS

| | | | |
|---|---|---|---|
| 1,875,567 | 9/1932 | Daniels | 53/212 |
| 3,659,394 | 5/1972 | Hartleib et al. | 53/216 X |
| 3,740,923 | 6/1973 | Itoda et al. | 53/212 |
| 4,089,151 | 5/1978 | Bergman et al. | 53/212 |
| 4,367,617 | 1/1983 | Miyazaki | 53/212 |
| 4,383,541 | 5/1983 | Uchida | 53/212 X |

*Primary Examiner*—Robert L. Spruill
*Assistant Examiner*—Steven P. Weihrouch
*Attorney, Agent, or Firm*—Stephen G. Rudisill

[57] ABSTRACT

A coin wrapping mechanism for wrapping rolls of coins comprises a coin stacking system for forming a coin stack containing a predetermined number of coins; vertical and lateral supporting members for supporting the coin stack for rotation about its axis; a driven roll with a resilient surface for rotating the coin stack about its axis while pressing a wrapping material against the coin stack, the wrapping material having a coating of a pressure-sensitive, releasable adhesive on the side facing the coin stack so that the adhesive adheres to, and is wound around, the coin stack; and an ejector for removing the coin stack from the wrapping station after the desired length of wrapping material has been wound around the coins.

4 Claims, 6 Drawing Figures

COIN WRAPPING MECHANISM

FIELD OF THE INVENTION

The present invention relates generally to coin wrapping mechanisms for forming coin rolls.

DESCRIPTION OF RELATED ART

Exemplary coin wrapping machines which are in commercial use today are shown in U.S. Pat. Nos. 3,886,957; 3,905,176; 3,906,964; 3,908,338; 3,925,966; 3,938,303; 3,950,921; 4,089,151; 4,102,110 and 4,412,550. These machines are complicated, requiring an extremely large number of different parts. In operation, these machines have been found to require, frequent service, and the attendant down time results in significant losses in productivity. One of the areas that is particularly troublesome is the guiding of the wrapping paper around the coin stack during the automatic, high-speed wrapping operation. The natural tendency of the paper is to follow a straight path, causing it to fly tangentially away from the coin stack and become entangled in the wrapping rolls which drive the coin stack.

SUMMARY OF THE INVENTION

It is a primary object of the present invention to provide an improved coin wrapping mechanism which reliably controls the wrapping material during the coin-wrapping operation, and without the use of complex guiding mechanisms. In this connection, a related object of the invention is to provide such an improved coin wrapping mechanism which minimizes malfunction and service problems due to entanglement of the wrapping paper with the wrapping mechanism.

Another important object is to provide such an improved coin wrapping mechanism which requires a relatively small number of parts and is highly reliable in operation. In this connection, a related object of the invention is to provide such an improved wrapping mechanism which requires relatively infrequent service with corresponding high productivity rates.

Still another object of this invention is to provide an improved coin wrapping mechanism which is capable of forming wrapped coin rolls at a fast rate and a low cost.

A further object of the invention is to provide an improved coin wrapping mechanism which can be efficiently and economically fabricated at a lower cost than present coin wrapping machines capable of operating at comparable production rates.

Other objects and advantages of the invention will be apparent from the following detailed description and the accompanying drawings.

In accordance with the present invention, the foregoing objects are realized by a wrapping mechanism which includes coin stacking means for forming a coin stack containing a predetermined number of coins; means for supporting the coin stack for rotation about its axis while pressing a wrapping material against the coin stack the wrapping material having a coating of a pressure-sensitive, releasable adhesive on the side facing the coin stack so that the adhesive adheres to, and is wound around, the coin stack; and means for terminating the rotation of the coin stack after the desired length of wrapping material has been wound around the coins. By adhering the leading edge of the wrapping material to the coin stack, the wrapping material is made to follow the rotating coin roll without the use of complicated guiding mechanisms. The wrapping material closely follows the contour of the coin stack as the wrapping material is wound around the entire circumference of the stack, so there are no loose ends or edges to become entangled in the wrapping mechanism.

DETAILED DESCRIPTION OF PREFERRED EMBODIMENTS

Figure 1:
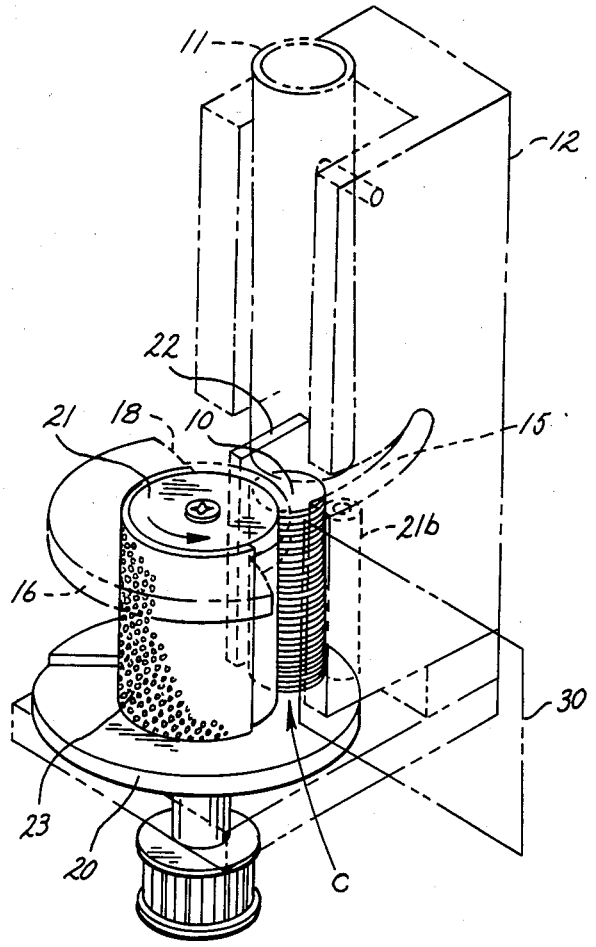
FIG. 1 is a perspective view of a coin wrapping mechanism embodying the present invention in a first stage of its operation.

While the invention is susceptible to various modifications and alternative forms, specific embodiments thereof have been shown by way of example in the drawings and will be described in detail herein. It should be understood, however, that it is not intended to limit the invention to the particular forms disclosed, but, on the contrary, the intention is to cover all modifications, equivalents, and alternatives falling within the spirit and scope of the invention as defined by the appended claims.

Figure 2:
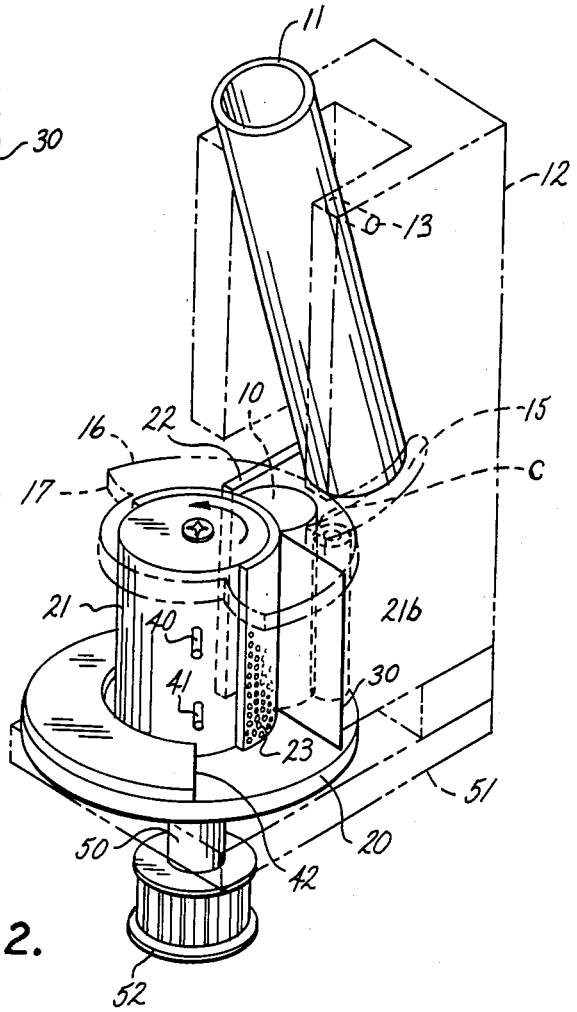
FIG. 2 is a perspective view of the coin wrapping mechanism of FIG. 1 in a second stage of its operation.
Figure 3:
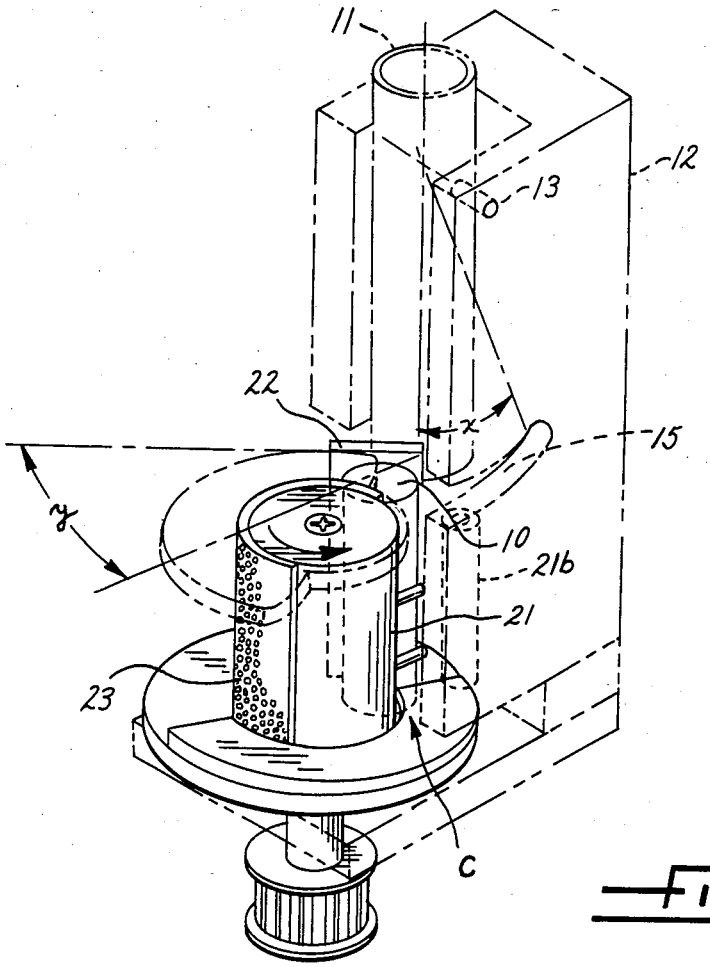
FIG. 3 is a perspective view of the coin wrapping mechanism of FIG. 1 in a third stage of its operation.
Figure 4:
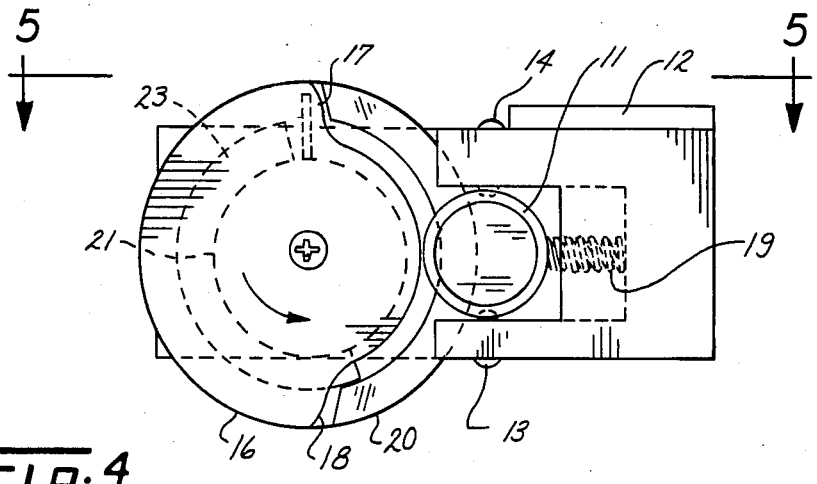
FIG. 4 is a top plan view of the coin wrapping mechanism of FIG. 1.
Figure 5:
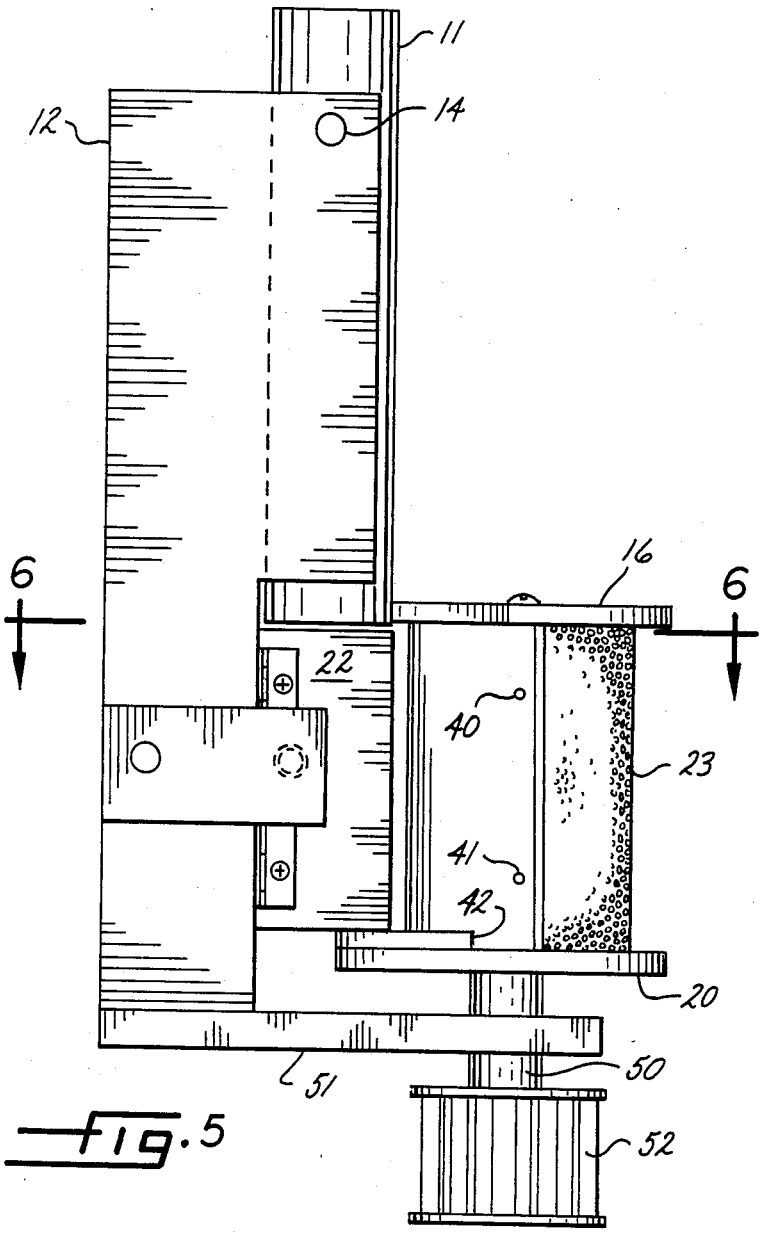
FIG. 5 is a side elevation taken generally along line 5—5 in FIG. 4.
Figure 6:
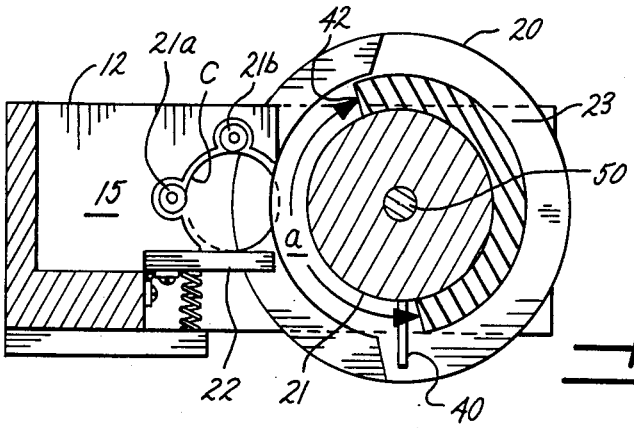
FIG. 6 is a section taken generally along line 6—6 in FIG. 5.

Turning now to the drawings, FIGS. 1, 2 and 3 illustrate the wrapping mechanism in three successive stages of operation. Referring first to FIG. 1, a coin stack 10 is loaded from a buffer tube 11 into a wrapping chamber C formed by a housing 12. The buffer tube 11 is pivotally supported in the upper portion of the housing 12 by a pair of diametrically opposed pins 13 and 14 fitting into recesses in the outside wall of the tube 11, so that the lower end of the tube can be pivoted through the angle between (1) a "load buffer" position (illustrated in FIGS. 1 and 2) where the bottom of the tube is blocked by a shoulder 15 formed by the housing 12 directly above and adjacent to the wrapping chamber C, and (2) a "load wrapper" position (illustrated in FIG. 3) where the bottom of the tube 11 opens directly into the wrapping chamber C. In the "load buffer" position, the tube 11 receives a pre-counted stack of coins in readiness for the next wrapping operation. In the "load wrapper" position, the stack of coins accumulated in the buffer tube 11 is dropped into the wrapping chamber C, ready to be wrapped.

The coin stack 10, which contains a prescribed number of coins of a given denomination, may be formed by any of a variety of different coin counting and stacking mechanisms, such as the one described in Nakamura et al U.S. Pat. No. 4,515,172. Such stacking mechanisms typically have a shutter which opens each time it is desired to load a new coin stack into the wrapping mechanism. When the shutter opens, the coin stack 10 drops into the buffer tube 11. Alternatively, the desired number of coins can be loaded into the buffer tube 11 by hand.

In order to pivot the buffer tube 11 to its retracted or "load buffere" position after the coins in the buffer tube have been dropped into the wrapping chamber C, rotatable cam 16 with a smoothly rounded leading edge 17 engages the outside wall of the tube 11 near the lower end thereof and pushes the lower end of the tube to its retracted position (as shown in FIGS. 1 and 2). The outer edge of the cam 16 then maintains the tube 11 in its retracted position throughout the wrapping of the coin stack in the wrapping chamber. When the trailing edge 18 of the cam 16 clears the tube 11, a spring 19 pivots the tube to its advanced or "load buffer" position (illustrated in FIG. 3). The relationship of the rotational movement of the cam 16 and the wrapping mechanism will be apparent from the ensuing description.

The stack of coins loaded into the wrapping chamber C rests on a disc 20 extending radially outwardly from the bottom of a wrapping roller 21 adjacent the wrapping chamber. Lateral support for the coin stack 10 is provided by a pair of idler rollers 21*a* and 21*b* recessed in the walls of the wrapping chamber C, a spring-loaded exit gate 22, and the wrapping roller 21. The coin stack 10 is free to rotate about its longitudinal axis while supported in this manner within the wrapping chamber. The cam 16 is mounted on the top of the wrapping roller 21, which extends slightly above the top of the coin stack 10.

A sheet of wrapping material 30, such as a plastic film or paper, is fed between the coin stack 10 and the wrapping roller 21, either manually or by an automatic sheet feeder. One side of this wrapping material 30, namely the side facing the coin stack 10, is coated with a pressure-sensitive, releasable adhesive 31, such as the adhesives disclosed in U.S. Pat. No. 4,418,120 as having good tack and shear properties but low peel adhesion to stainless steel. That is, the adhesive should adhere quickly to the outer surface of a stack of coins and have sufficient shear strength to hold the stack of coins together during handling, and yet have a peel adhesion low enough to permit the paper to be readily peeled off the coin roll without leaving any substantial residue of adhesive on the coins. The adhesive coating 31 is preferably continuous along the full length and across the full width of the material 30.

In order to press the wrapping material 30 against the coin stack 10, while simultaneously rotating the coin stack, a resilient rubber or foamed-polymer pad 23 is bonded to the outer surface of the wrapping roller 21. It will be noted that the resilient pad 23 does not extend all the way around the circumference of the wrapping roller 21, thereby forming an "open" angle a within which a new sheet of wrapping material 30 can be inserted into the throat between the roller 21 and the coin stack 10 in each revolution of the roller. Then when the leading edge of the resilient pad 23 engages the new sheet of wrapping material, the pad 23 presses the leading edge of the wrapping material 30 against the coin stack. Because of the adhesive coating on the side of the wrapping material 30 facing the coin stack, the wrapping material adheres to the coin stack.

Continued rotation of the roller 21 and the pad 23 causes the coin stack to rotate because the resilient pad 23 continues to press against the coin stack, through the wrapping material 30. As the coin stack is rotated, the sheet of wrapping material 30 follows the rotating surface of the stack, both because the wrapping material is adhered to the surface of the stack and because the wrapping material is drawn into the nip between the roller 21 and the coin stack 10, and continues to be pressed against the coin stack, by the resilient pad 23. Thus, the wrapping material is wound tightly around the coin stack 10 as the stack is driven by the pad 23.

In the illustrative embodiment, the circumferential length of the pad 23 is only slightly longer than the circumference of the coin stack, so that only one layer of the wrapping material is wound around the major portion of the stack. It will be recognized, however, that the diameter of the roller 21 and/or the circumferential length of the pad 23 can be increased to wrap two or more layers of wrapping material around the stack of coins. If desired, the pad 23 can extend around the entire circumference of the roller 21, with the roller being retracted away from the coin stack during a portion of each revolution to allow a new sheet of wrapping material 30 to be fed into the wrapping mechanism.

The height of the resilient pad 23 is slightly greater than the height of the coin stack 10 to ensure that the last coin at both ends of the stack is secured by the wrapping material. If desired, a small extra length of wrapping material can be folded over the ends of the coin stack, but there is no need for the crimping operation required by present coin wrapping machines, because the coins are retained within the wrapper by the adhesive coating on the wrapping material.

As the trailing edge of the resilient pad 23 clears the coin stack 10, rotation of the coin stack ceases. At this point, the sheet of wrapping material 30 has been wound around the entire circumference of the coin stack 10 and releasably bonded thereto. To eject the wrapped coin roll from the wrapping mechanism, a pair of ejector pins 40 and 41 project laterally from the wrapping roller 21 a short distance behind the trailing edge of the resilient pad 23. As these ejector pins 40 and 41 come into engagement with the wrapped coin roll, they push the coin roll against the spring-loaded exit gate 22, thereby pushing the gate open against its spring bias through and angle Y, and ejecting the wrapped coin roll through the opened gate. At the same time the ejector pins 40 and 41 engage the coin roll, a shoulder 42 on the support disc 20 also engages the wrapped coin roll and assists in ejecting the coin roll from the wrapping mechanism. After the coin roll has cleared the gate 22, the spring load on the gate returns the gate to its closed position.

For the purpose of driving the wrapping roller 21 and the cam 16 and support disc 20 attached to the upper and lower ends thereof, the roller 21 is fastened to a drive shaft 50 journaled in a support plate 51 cantilevered from the bottom of the housing 12. The drive shaft 50 in turn carries a drive pinion 52 which can be driven by any suitable drive means, such as a toothed belt driven by an electric motor. If desired, the drive shaft 50 could be driven directly by an electric motor.

As can be seen from the foregoing detailed description, this invention provides an improved coin wrapping mechanism which requires only a small number of parts and thus is highly reliable in operation. It requires relatively infrequent service with corresponding high productivity rates. This mechanism is capable of forming wrapped coin rolls at a fast rate and a low cost, and minimizes malfunction and service problems by avoiding problems of entanglement of the wrappin paper with the wrapping mechanism. Furthermore, this mechanism can be efficiently and economically fabricated at a lower cost than present coin wrapping machines capable of operating at comparable production rates.

I claim:

1. A coin wrapping mechanism for wrapping rills of coins, said mechanism comprising:

coin stacking means for forming a coin stack containing a redetermined number of coins, means for supporting the coin stack for rotation about its axis, means for rotating the coin stack about its axis while pressing a wrapping material against the coin stack, said wrapping material having a coating of a pressure-sensitive, releasable adhesive on the side facing the coin stack so that the adhesive adheres to, and is wound around, the coin stack, said rotating and pressing means including a resilient member urging said wrapping material against said coin stack, and means for effecting rolling movement of the circumferencial surface of said coin stack over the surface of said resilient member to effect the winding of said wrapping material around said coin stack, said resilient member being dimensioned to be spaced away from the coin stack during a portion of said rolling movement to allow (1) removal of the wrapped coin stack, (2) loading of a new coin stack, and (3) insertion of the wrapping material between the coin stack and said resilient member and means for removing the coin stack from the rotating and pressing means after the desired length of wrapping material has been wound around the coins.

2. The coin wrapping mechanism of claim 1 wherein said means for rotating the coin stack includes a driven wrapping roller, and which includes a wrapping chamber having gate means for permitting the wrapped coin stack to be removed from the wrapping chamber in the direction of rotation of the driven wrapping roller.

3. The coin wrapping mechanism of claim 2 wherein said wrapping roller includes means for positively moving the wrapped coin stack through said gate means upon completion of the wrapping step.

4. A coin wrapping mechanism for wrapping rolls of coins, said mechanism comprising:

coin stacking means for forming a coin stack containing a predetermined number of coins, said coin stacking means including a buffer tube for holding a coin stack directly adjacent said supporting means, said buffer tube being pivoted for movement between a first position where the lower end of the tube is aligned with said supporting means for loading a stack of coins onto said supporting means, and a second position where the lower end of the tube is closed so the tube can receive a new stack of coins through its upper end, means for supporting the coin stack for rotation about its axis, means for rotating the coin stack about its axis while pressing a wrapping material against the coin stack, said wrapping material having a coating of a pressure-sensitive, releasable adhesive on the side facing the coin stack so that the adhesive adheres to, and is wound around, the coin stack, means for removing the coin stack from the rotating means after the desired length of wrapping material has been wound around the coins, and cam means mounted for rotation in synchronism with the rotation of said coin stack for moving said buffer tube from said first position to said second position.

* * * * *